US005864978A

United States Patent [19]

McRary et al.

[11] Patent Number: 5,864,978

[45] Date of Patent: Feb. 2, 1999

[54] SOLID SYNTHETIC WEAPON STOCKS

[75] Inventors: Thomas O. McRary, Hickory; Tyrone R. Bishop, Lenoir, both of N.C.

[73] Assignee: T²Stocks, Inc., Hickory, N.C.

[21] Appl. No.: 746,762

[22] Filed: Nov. 15, 1996

[51] Int. Cl.[6] ..... F41C 23/10; F41C 23/18

[52] U.S. Cl. ..... 42/71.01; 42/71.02; 264/27.3; 264/DIG. 6

[58] Field of Search ..... 42/71.01, 71.02; 264/257, 258, DIG. 6, 328.17

[56] References Cited

U.S. PATENT DOCUMENTS

| | | | |
|---|---|---|---|
| 1,495,206 | 5/1924 | Ruppel . | |
| 2,205,891 | 6/1940 | Sprenger | 42/71.01 |
| 2,274,060 | 2/1942 | Hart . | |
| 2,753,642 | 7/1956 | Sullivan | 42/71.01 |
| 2,754,546 | 7/1956 | Mason et al. . | |
| 3,011,283 | 12/1961 | Lunn et al | 42/71.01 |
| 3,023,527 | 3/1962 | Leek et al | 42/71.01 |
| 3,299,558 | 1/1967 | Karl . | |
| 3,623,257 | 11/1971 | Ray . | |
| 3,815,270 | 6/1974 | Pachmayr | 42/71.02 |
| 4,250,136 | 2/1981 | Rex | 264/257 |
| 4,290,220 | 9/1981 | Ruger | 42/75 |
| 4,346,530 | 8/1982 | Stewart et al. | 42/71 R |
| 4,385,464 | 5/1983 | Cassull | 42/75 C |
| 4,674,216 | 6/1987 | Ruger et al. | 42/71.01 |
| 4,936,036 | 6/1990 | Sniezak et al. | 42/71.02 |
| 4,999,941 | 3/1991 | Farrar | 42/71.02 |
| 5,665,295 | 9/1997 | Takamoto et al. | 264/258 |

FOREIGN PATENT DOCUMENTS

| | | |
|---|---|---|
| 979843 | 5/1951 | France . |
| 216094 | 11/1984 | German Dem. Rep. . |
| 2017087 | 10/1971 | Germany . |
| 204182 | 1/1980 | U.S.S.R. . |
| 679570 | 9/1952 | United Kingdom . |

OTHER PUBLICATIONS

Washington Evening Star, Oct. 27, 1939, "Better Gunstocks Made With Synthetic Material", By Selence Service.

*Primary Examiner*—Angela Ortiz
*Attorney, Agent, or Firm*—Hinkle & Associates, P.C.

[57] ABSTRACT

A solid, single-pour synthetic weapon stock comprises polyurethane and an equal amount by volume of a spacing material of silica-alumina ceramic microspheres blended into the polyurethane. For additional strength, a U-shaped bar having spaced apart bores is disposed within the weapon stock. A process for manufacturing the polyurethane weapon stock, comprises the steps of blending polyurethane with the spacing material to form a polyurethane reactant, placing the U-shaped bar into a mold having a void of a shape of the weapon stock, pouring the polyurethane reactant into the void and allowing the polyurethane reactant to react to form a polyurethane object having the shape of the void, curing the polyurethane object and removing the polyurethane object from the mold.

6 Claims, 3 Drawing Sheets

SOLID SYNTHETIC WEAPON STOCKS

BACKGROUND OF THE INVENTION

I. Field of the Invention.

The present invention relates generally to the field of weapon stocks. More particularly, the present invention relates to single pour, polyurethane stocks suitable for use with rifles and shotguns and single pour, polyurethane pistol hand grips.

II. Description of the Related Art.

Stocks for various weapons have been and continue to be manufactured from wood. Not only does wood provide natural beauty, it also provides workability and relatively light weight. A craftsman can engrave, bore or generally work the wood to add any desired ornamental or functional feature to the stock. However, wood is very sensitive to atmospheric relative humidity, resulting in the wood stock shrinking in "dry" conditions and expanding in "wet" conditions. For competitive marksmen, this is particularly bothersome since relative humidity from one location to another varies. In fact, relative humidity can vary at a single location throughout a given day. As a result, the competitive marksman often needs to recalibrate the weapon's sight at each shooting match to overcome this disadvantage. This recalibration, or zeroing, of the weapon is time consuming. Due to the limited time between the rounds of the match, it may not be possible to recalibrate the weapon and the marksman is therefore hampered.

To alleviate this problem, craftsmen developed synthetic stocks which do not react to the relative humidity. This enables the marksman to travel from one location to another with the weapon zeroed for his or her body. Unfortunately, the physical construction of such synthetic stocks do not allow modifications for ornamental or functional features like wood stocks. Further, because the synthetic materials are generally more dense than wood, it is desirable for the weight of the stocks be reduced to that of comparable wood stocks. Typically, these synthetic stocks have outer skins which may not be ruptured without loss of structural integrity in weapon firing applications.

Popular synthetic stocks are currently commercially available. One such stock manufactured by Bell and Carlson, Inc. has a hollow core with successive layers of graphite, KEVLAR, fiberglass and an outer skin of polyurethane. Another popular stock by McMillan Fiberglass Stocks, Inc. is manufactured by an injection-molding process in combination with an epoxy impregnated, high-pressure laminated fiberglass cloth and chopped glass strands.

A gun stock of expanded cellular plastic material described in U.S. Pat. No. 2,753,642 by Sullivan has a preformed external skin of durable material and a core of low density, rigid and expanded cellular plastic within and secured to the skin. The skin is a thermoplastic sheet of tough, synthetic and rubber-like plastic. Poured into the skin to harden and cure, the core is a reactant alkyd resin meta-toluene-diisocyanate mixture or a phenolic type foam/cellular plastic. Although the core appears to be poured, the stock is made of two parts and the strength is derived from the skin. Even though Sullivan mentions polyurethane as a suitable material, the problems of the stock weight and the manufacture of a solid, single pour stock are not addressed.

U.S. Pat. No. 3,299,558 issued to Karl describes a metal gun barrel with encircling plastic layer and integral plastic sight. A molded gun stock is provided which is an integral part of the plastic coating. Suitable plastics are described as nylon, TEFLON, neoprene, polyvinyl, polyethylene, polyurethane and acetal resin. The process by which the stock is molded is not described within the patent.

A polyurethane foam gun stock is described in German Patent Number 2017087 by Allgaier. This stock has a hard, smooth and non-porous skin and a core having a density which is 50% of the skin density. The skin is described as being more dense than wood and the core is describe as being less dense than wood. It is clear that the strength of the stock is derived from the skin and the stock is not manufactured by a single pour process.

SUMMARY OF THE INVENTION

In accordance with the present invention and the contemplated problems which have and continue to exist in this field, the objectives of this invention are to provide:

- a solid, synthetic weapon stock having the workability, strength, durability and comparable weight of a wooden stock;
- a process for manufacturing the solid synthetic weapon stock;
- a solid, single-pour weapon stock made of polyurethane;
- a U-shaped bar disposed within the weapon stock for additional strength;
- a solid, synthetic weapon stock suitable for use as a rifle stock, a shotgun stock and a pistol grip; and,
- a weapon stock which is suitable for rifles used in competitive shooting events.

This invention accomplishes the above and other objectives and overcomes the disadvantages of the prior art by providing a solid, single-pour polyurethane weapon stock that is simple in design and construction, inexpensive to fabricate, and easy to use. The solid, single-pour synthetic weapon stock comprises polyurethane and an equal amount by volume of a spacing material of silica-alumina ceramic microspheres blended into the polyurethane. For additional strength, a U-shaped bar having spaced apart bores is disposed within the weapon stock. A process for manufacturing a polyurethane weapon stock, comprising the steps of blending polyurethane with the spacing material to form a polyurethane reactant, placing the U-shaped bar into a mold having a void of a shape of the weapon stock, pouring the polyurethane reactant into the void and allowing the polyurethane reactant to react to form a polyurethane object having the shape of the void, and curing the polyurethane object.

It is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

Other objects, advantages and capabilities of the invention will become apparent from the following description taken in conjunction with the accompanying drawings showing the preferred embodiment of the invention.

BRIEF DESCRIPTION OF THE DRAWINGS

The invention will be better understood and the above objects as well as objects other than those set forth above will become apparent when consideration is given to the following detailed description thereof. Such description makes reference to the annexed drawings wherein.

DESCRIPTION OF THE PREFERRED EMBODIMENTS

Figure 1:
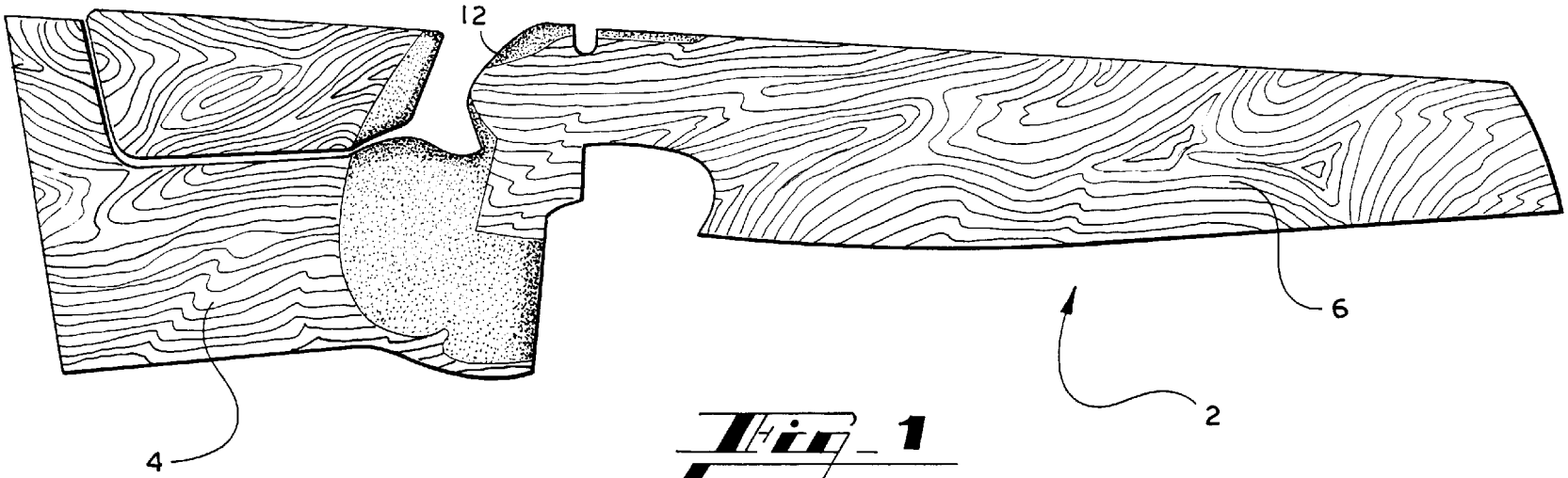
FIG. 1 is a side elevation view of one embodiment of a weapon stock manufactured in accordance with a method of this invention particularly adapted for use with a rifle.

For a fuller understanding of the nature and desired objects of this invention, reference should be made to the following detailed description taken in connection with the accompanying drawings. Referring to the drawings wherein like reference numerals designate corresponding parts throughout the several figures, reference is made first to FIG. 1. FIG. 1 of the drawings illustrates a side elevation view of an embodiment of a typical weapon stock 2 manufactured in accordance with the present invention. The weapon stock 2 illustrated in FIG. 1 is specifically adapted for use with a rifle (not shown). It should be noted that the term "weapon stock" is utilized in a generic since, in that stocks manufactured according to the method described herein are not limited to a specific shape. This invention is readily adaptable for the manufacture of rifle stocks, shotgun stocks and pistol grips of a desired shape by a manufacturer, and accordingly, the embodiments of rifle stocks, shotgun stocks and pistol grips are included within the meaning of weapon stocks as encompassed by this invention and as claimed in the appended claims hereto.

Figure 2:
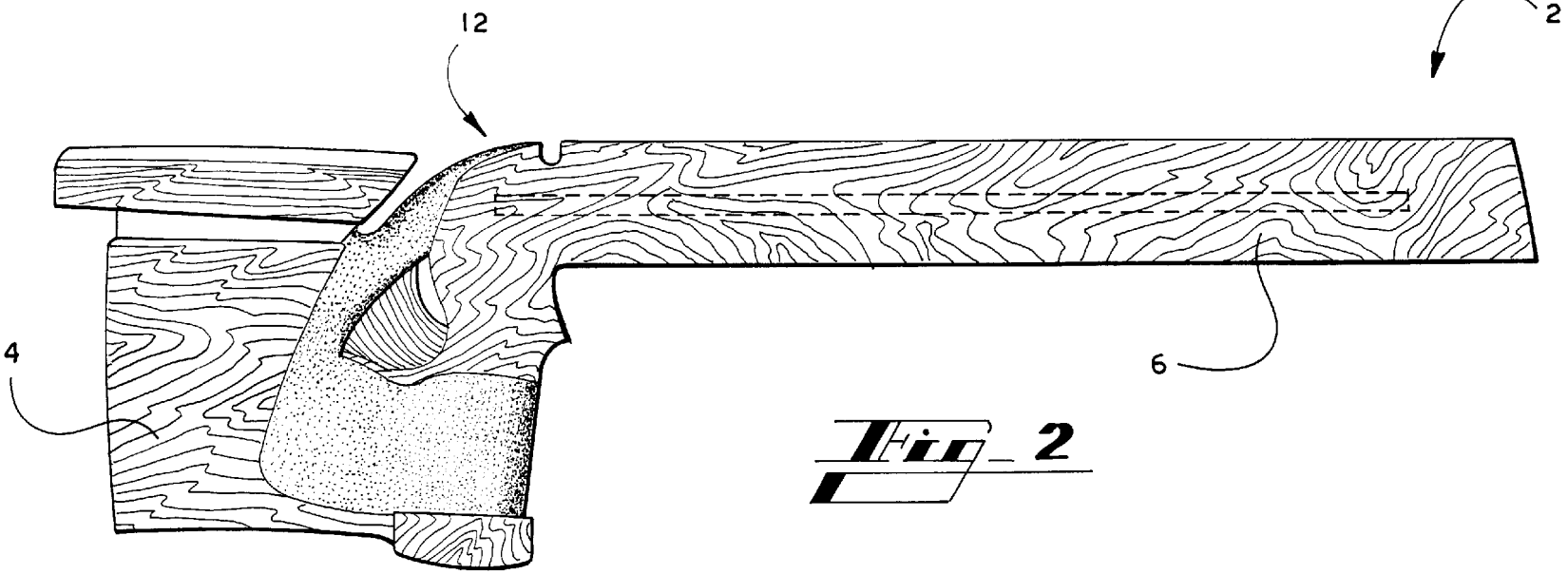
FIG. 2 is a side view of the weapon stock of FIG. 1 showing the U-shaped bar disposed within the weapon stock with imaginary lines.
Figure 3:
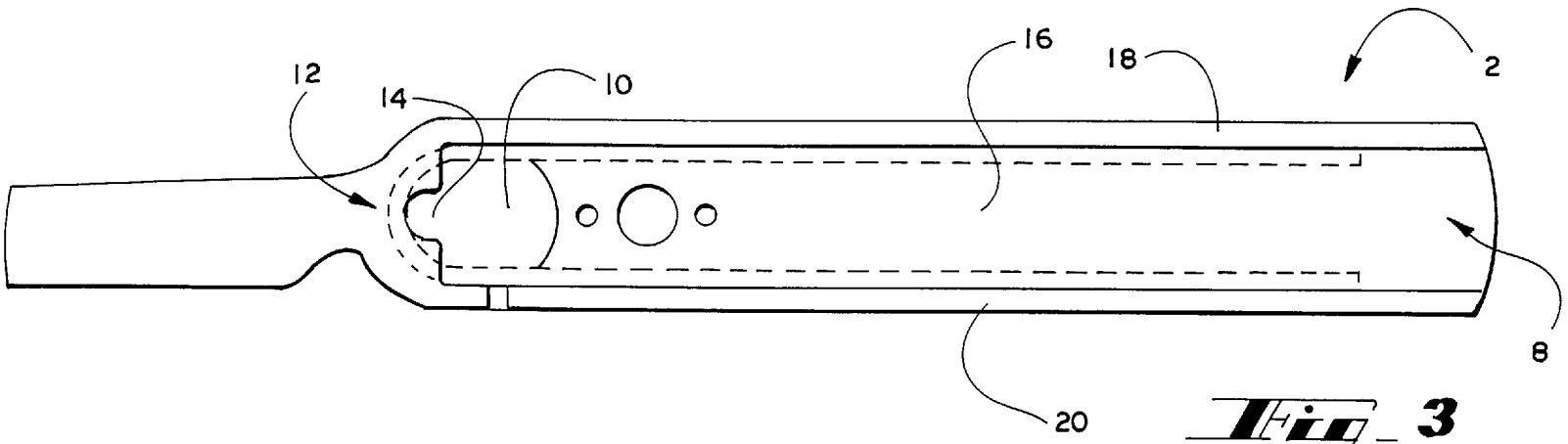
FIG. 3 is a top view of the weapon stock of FIG. 1 showing a U-shaped bar disposed within the weapon stock with imaginary lines.

To better clarity the invention herein, reference should be additionally given to FIGS. 2 and 3. The weapon stock 2 has a butt portion 4 and a forestock portion 6 that extends from the butt portion 4. It is the forestock portion 6 which receives the barrel (not shown), trigger mechanism (not shown) and associated action parts (not shown). The forestock portion 6 has a barrel channel 8 to receive the barrel, a trigger mechanism bore 10 to receive the trigger mechanism, a rear receiver portion 12 adjacent the butt portion 4 and a rear receiver tang slot 14 disposed between the trigger mechanism bore 10 and the rear receiver portion 12 to receive the rear receiver tang (not shown). Typically, the barrel channel 8 has a curved channel surface 16 that extends along a longitudinal axis of the barrel channel 8 to form a channel first side 18 and a channel second side 20 on either side of the longitudinal axis. Generally, the channel first and second sides 18 and 20 are parallel to each other.

Major considerations for weapon stock materials are weight and workability. Historically, a hard wood, such as oak and ash, has been used for weapon stocks 2 for the properties of strength, durability, workability and natural beauty. However, because wood responds to atmospheric relative humidity, it is not always desired as the weapon stock material. Polyurethane is an excellent material for a wood replacement due to its low cost, strength, durability and workability. Unfortunately, because polyurethane is a relatively dense material, which directly relates to the aforementioned desired properties, objects made from polyurethane in unaltered form are generally heavier than like objects made of wood. This invention now makes it desirable to utilize polyurethane as a weapon stock material.

In the present invention, polyurethane resin is uniformly blended with an inert spacing material in equal parts by volume, poured into a mold containing a reinforcement object, and allowed to react and cure to form a weapon stock 2. It is important for the polyurethane resin to have a working life and remain flowable while being blended with the spacing material so that it may be poured into the mold. Further, for uniform strength of the weapon stock 2, it is important for the polyurethane resin being poured into the mold remain relatively free from entrained air bubbles.

There are many methods to make polyurethane and any such method may be exercised by this invention. This is because any such method can be simplified into a combination of two components; for example, a resin component and a hardener component. The most important feature of the method employed is that there be sufficient working life of the polyurethane resin to blend the spacing material into the polyurethane resin and subsequently pour the mixture into a mold prior to reaction. A satisfactory polyurethane for this invention is marketed under the tradename "TD 280-06 Elastoplastic" by Innovative Polymers, Inc. This polyurethane has a resin component of methylene diisocynate and a hardener component of polyether polyol. These components are mixed equally by weight. At 77 degrees F., the resin viscosity is 45 centipoise, the hardener viscosity is 800 centipoise and the initial mixed viscosity is 400 centipoise. Upon mixing of the components, there is a 10 to 15 minute working life before the polyurethane begins to react and solidify. This particular polyurethane may be removed from a mold within eight to twenty-four hours and has an ultimate cure of seven days. Also, contained in the hardener is a zinc based salt catalyst having an amount between 0.1 to 1.0 percent by weight of the polyether polyol, a silicon surfactant in an amount of about 0.01 percent by weight of the polyether polyol and a moister absorbent in an amount between 2 and 5 percent by weight of the polyether polyol. In this polyurethane, the moister absorbent is mole sieves. Additionally, the hardener may contain an amine crosslinker.

As previously mentioned, an inert spacing material is added to the polyurethane. By adding the spacing material to the polyurethane, the weight of the solid weapon stock 2 can be reduced with retention of the desired properties of low cost, strength, durability and workability. The composition of the spacing material may be varied as long as it is inert, has a size range of 0.3 to 12 microns, and preferably has a density of 2.5 g/cc and a median size by volume of 4.4 microns. It is also preferred that the spacing material have particles with a substantially spherical shape. Microparticles having shapes other than spherical may also be utilized as spacing material in accordance with the invention hereof. An acceptable spacing material is silica particles. The preferred spacing material marketed under the tradename "Zeospheres G-200" is silica-alumina ceramic microspheres having the aforementioned size range and density.

Figure 4:
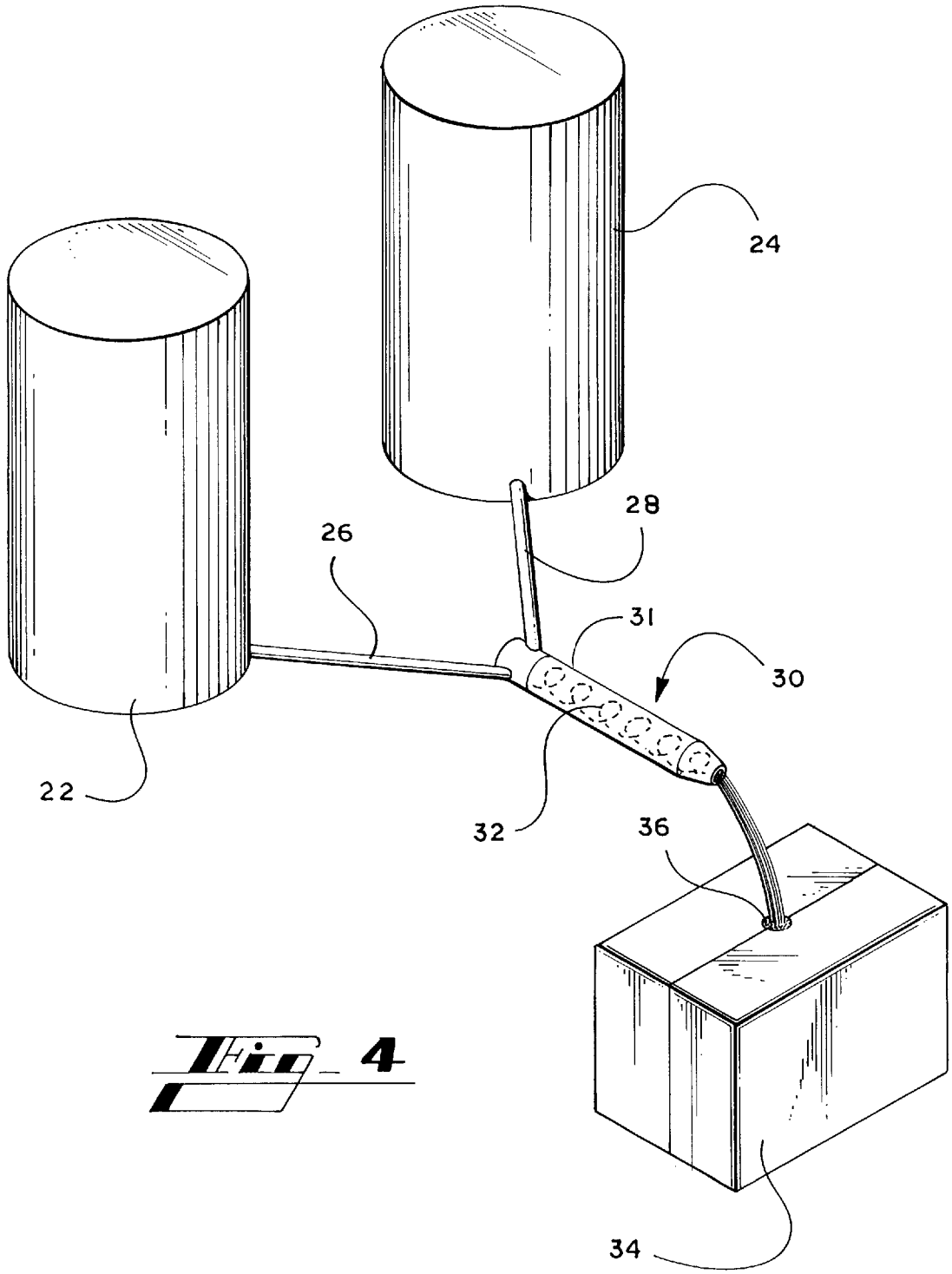
FIG. 4 is a flow diagram of a process for manufacturing a solid, synthetic weapon stock in accordance with the present invention; and, FIG. 5 is a prospective view of the U-shaped bar.

As shown in the flow diagram of FIG. 4, to manufacture the solid, single pour polyurethane weapon stock 2, the resin component, preferably methylene diisocynate, is placed in a first tank 22. Likewise, the hardener component, preferably polyether polyol containing the catalyst, the surfactant and the moister absorbent, is placed in a second tank 24. Silica-alumina ceramic microspheres, as previously described, are blended with the resin component in an amount of fifty percent by volume to form a resin blend. Also, silica-alumina ceramic microspheres are blended with the hardener component in an amount of fifty percent by volume to form a hardener blend. The microspheres should be blended so that they are uniformly dispersed throughout the resin and hardener blends. Next, the resin and hardener blends are independently and respectively conveyed by first and second hoses 26 and 28, preferably by gravity feed, to an air-free mixer 30. The mixer 30 in the preferred embodiment is a static tube 31, which has an internal rotating screw extruder 32 disposed within a mixing bore (not shown). Air is driven from the static tube 31 as materials flow through it, enabling uniform mixing of materials without the entrainment of air bubbles. The resin and hardener blends are mixed in equal amounts by weight in the static tube 31 at a temperature between 72 degrees F. and 130 degrees F., preferably 77 degrees F., to form a polyurethane reactant. From the static tube, the polyurethane reactant is poured directly into a mold 34. The mold 34 has a void 36 having a predetermined shape of the desired weapon stock 2. Preferably, the mold 34 is separable and has only two parts so as to minimize seams on the weapon stock 2.

Figure 5:
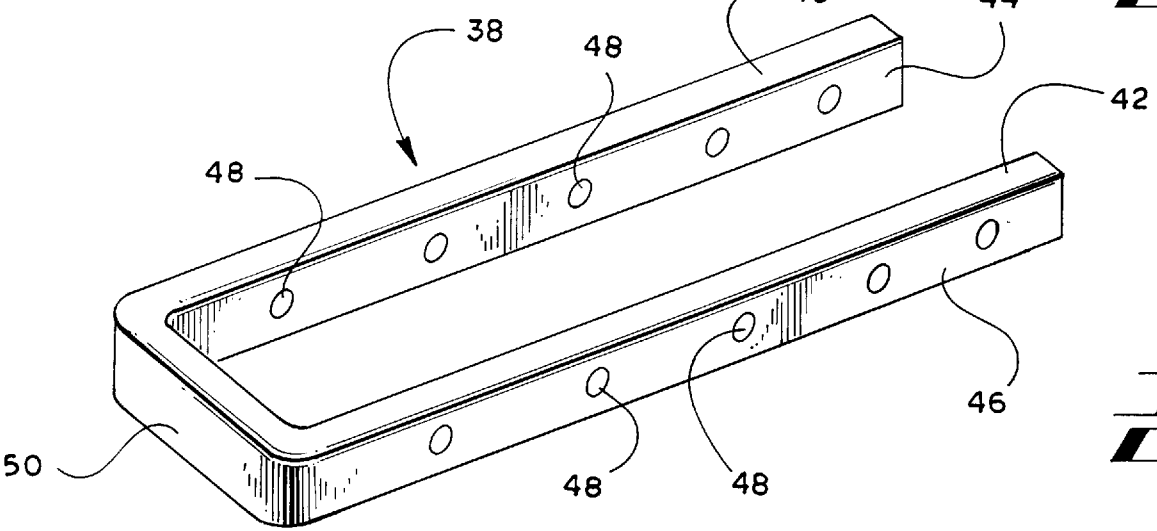

Although not required in all applications of the weapon stock 2, a reinforcement object, such as a rod, a band or preferably a U-shaped bar 38 is placed into the void 36 prior to the addition of the polyurethane reactant. It is preferred for the U-shaped bar 38 to be made of aluminum. As shown in FIG. 5, the U-shaped bar 38 has a first arm 40, a second arm 42, an inner face 44, an outer face 46 and a plurality of spaced apart bores 48 disposed between and in conjunction with the inner and outer faces 44 and 46. Disposed between the first and second arms 40 and 42 is a force-receiving section 50 that is substantially perpendicular to the arms 40 and 42. The placement of the U-shaped bar 38 within the void 36 is such that the U-shaped bar 38 is disposed within the weapon stock 2 with the first arm 40 substantially adjacent to the channel first side 18, the second arm 42 substantially adjacent to the channel second side 20 and the force-receiving section 50 substantially adjacent to the rear receiver portion 12. By having this configuration, the weapon stock 2 is provided additional strength at the weakest area of the stock which, incidentally, receives the most force from the recoil of the weapon as it is fired. The bores 48 of the U-shaped bar 38 arc provided to enable the polyurethane reactant to flow through the bores 48 and lock the U-shaped bar 38 in place once the polyurethane reactant solidifies into polyurethane, which additionally distributes part of the recoil force to the forestock 6 as the weapon is fired.

As previously stated, the polyurethane reactant begins to react within ten to fifteen minutes from being poured into the mold, since the pouring step essentially occurs simultaneously with the mixing of the resin blend and the hardener blend. Reactions to create polyurethane are exothermic and thus generate heat. As the reaction progresses, the temperature within the mold rises to between 130 degrees F. and 156 degrees F. Obviously, the higher the temperature at mixing, the higher the temperature during reaction. As the reaction continues, the polyurethane reactant solidifies and forms a polyurethane object having the shape of the weapon stock 2, which is defined by the shape of the void 36. The polyurethane object is allowed to cure within the mold for at least twelve hours at the reaction temperature to form a polyurethane weapon stock 2. During the curing period, there is no need to either heat or cool the mold from ambient temperature conditions. After the curing step, the mold 34 is separated and the polyurethane weapon stock 2 is removed from the mold 34.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A solid, single-pour polyurethane weapon stock, comprising:

a single-poured polyurethane having a substantially uniformly blended spacing material therein;

the weapon stock having a rear receiver portion and a U-shaped bar substantially embedded within the weapon stock proximate the rear receiver portion, the U-shaped bar having an inner face, an outer face and at least one bore disposed between and in conjunction with the inner and outer faces, whereby polyurethane is disposed through the bore to prevent movement of the U-shaped bar;

the weapon stock having a barrel channel having a channel first side and a channel second side;

the U-shaped bar having a first arm, a second arm and a force-receiving section disposed between the first and second arms; and the U-shaped bar is disposed within the weapon stock with the first arm substantially adjacent to the channel first side the second arm substantially adjacent to the channel second side and the force-receiving section substantially adjacent to the rear receiver portion.

2. The weapon stock as claimed in claim 1, wherein the spacing material is microspheres being substantially spherically shaped and having a diameter in the range of 0.3 microns to 12.0 microns.

3. The weapon stock as claimed in claim 2, wherein the microspheres are silica-alumina ceramic microspheres.

4. The weapon stock as claimed in claim 1, wherein the polyurethane comprises about fifty percent by volume and the spacing material comprises about fifty percent by volume.

5. The weapon stock as claimed in claim 1, wherein the weapon stock has a butt portion and a forestock portion, the forestock portion has the rear receiver portion, the barrel channel and a trigger mechanism bore for the reception of a trigger mechanism.

6. A solid, single-pour polyurethane weapon stock, as claimed in claim 1, wherein:

the single-pour polyurethane of uniform density has a single layer throughout of substantially uniformly blended spacing material therein;

the spacing material being micro spheres being substantially spherically shaped and having a diameter in the range of 0.3 microns to 12.0 microns;

the micro spheres being silica-alumina ceramic micro spheres;

the polyurethane comprising about 50% by volume and the spacing material comprising about 50% by volume.

* * * * *